US005196641A

United States Patent [19]

Schaller

[11] Patent Number: 5,196,641

[45] Date of Patent: Mar. 23, 1993

[54] VIBRATO TAILPIECE FOR GUITAR

[75] Inventor: Helmut F. K. Schaller, Feucht, Fed. Rep. of Germany

[73] Assignee: Schaller Electronic, Feucht, Fed. Rep. of Germany

[21] Appl. No.: 839,912

[22] Filed: Feb. 21, 1992

[51] Int. Cl.[5] ..... G10D 3/00; G10H 1/053; G10H 3/18

[52] U.S. Cl. ..... 84/740; 84/299; 84/313

[58] Field of Search ..... 84/267, 299, 313, 739, 84/740

[56] References Cited

U.S. PATENT DOCUMENTS 4,658,693 4/1987 Hennessey ..... 84/313

4,867,031 9/1989 Fender ..... 84/313

*Primary Examiner*—Stanley J. Witkowski

*Attorney, Agent, or Firm*—McCormick, Paulding & Huber

[57] ABSTRACT

A vibrato tailpiece used with an electric guitar is operable to vary the tension of the strings about fundamental tension values and, for occasions when the string tension is so far relaxed as to permit the strings to move loosely relative to their supporting surfaces, the tailpiece includes guide means associated with each string to assure return of each string to its original position on its string supporting surface when it is returned to its fundamental tension. In this way possible de-tuning of the strings due to lateral displacement of them on their string supporting surfaces is avoided.

13 Claims, 3 Drawing Sheets

VIBRATO TAILPIECE FOR GUITAR

BACKGROUND OF THE INVENTION

The invention relates to tailpieces for guitars of the type which serve to provide both an anchor for one end of each string of the guitar and a string supporting surface for each string serving as a bridge and which further include a means manually operable by the performer to vary the tension of the strings about fundamental values to introduce vibrato or other pitch change effects into the sounds generated by the strings; and deals more particularly with improvements in such tailpieces providing more reliable performance characteristics.

Tailpieces of the type with which the invention is concerned are known as vibrato tailpieces since they permit the introduction of pitch varying effects to the output of guitars, with vibrato, that is, a generally steady oscillating variation of pitch about a fundamental frequency being perhaps the most frequently used one of such effects. Such tailpieces are also sometimes referred to as "tremolo tailpieces", but such designation is not too apt since the word "tremolo" refers to a variation of loudness rather than a variation of pitch.

In playing a guitar equipped with a vibrato tailpiece the performer, as mentioned above, can operate the tailpiece to manually vary the tension of the strings. That is, each string has a fundamental tension, at which it has a desired fundamental pitch or tone, and through operation of the tailpiece the tension of each string can be either increased above its fundamental tension to increase its pitch or relaxed from its fundamental tension to decrease its pitch. When the strings are at their fundamental tensions and pitches the force existing between each string and its string supporting surface tends to hold the string at a fixed position on the saddle providing the string supporting surface, and in some cases the saddle may include a notch which receives the string and aids in holding its position relative to the saddle.

For maintenance of the correct fundamental pitches of the strings it is important that the strings keep fixed positions relative to their string supporting surfaces. However, when a vibrato tailpiece is operated to relax the tension of the strings the force existing between each string and its string supporting surface is also reduced. Therefore, when this occurs a string may shift laterally away from its original position on its string supporting surface, and when the performer releases the actuating arm of the tailpiece mechanism the string may retain its laterally displaced position causing it to be de-tuned. This opportunity for the strings to become de-tuned by shifting laterally relative to their string supporting surfaces is particularly present in instances where the tailpiece is operated to produce what is sometimes referred to as a "dive-bombing" sound effect where the string tensions are relaxed to such a degree that the strings become completely free of tension so as to be loose and able to move in a floppy manner relative to the pickup heads, the tailpiece and other parts of the guitar.

The object of the present invention is therefore to provide a vibrato tailpiece which avoids the above described possible de-tuning of the strings resulting from temporary relaxation of the string tensions through operation of the tailpiece mechanism.

It is also often desirable when playing an electric guitar for the performer to be able to introduce a muting effect by lightly touching the strings with his or her pick hand at points close to the string supporting surfaces of the tailpiece. A further object of the invention is therefore to provide a means for avoiding the aforementioned de-tuning effect which does not interfere with the performer's access to the strings for muting purposes.

Other objects and advantages of the invention will be apparent from the following detailed description of preferred embodiments of the invention and from the accompanying drawings and claims.

SUMMARY OF THE INVENTION

The invention resides in a vibrato tailpiece, and in an electric guitar including such tailpiece, for attachment to an electric guitar body. The tailpiece includes a base and a means for attaching the base to the guitar body for rotation about an axis extending generally perpendicular to the strings. Included on the base is a means for anchoring one end of each string to the base and a plurality of saddles each having an upwardly facing string supporting surface for supporting an associated one of the strings. The string supporting surface of each saddle has a dimension extending perpendicularly to its string approximately equal to the diameter of the string, and each saddle further includes guide surfaces extending upwardly on either side of its string supporting surface to restrain the associated string to movement to the same position on the string supporting surface of the saddle each time it moves into engagement with the saddle from a condition of looseness relative to the saddle.

The guide surfaces associated with each string supporting surface may diverge from one another in extending upwardly from the string supporting surface, and a part of the saddle may connect to one another the upper ends of the two guide surfaces so as to form a hole in the saddle through which the string passes with the hole being defined in part by the string supporting surface and the two guide surfaces. Still further, the string supporting surface and the two guide surfaces on opposite sides of it for each saddle may be defined by a roller carried by the saddle body and rotatable relative to the saddle body about an axis extending perpendicularly relative to the string, with the roller having a generally V-shaped annular peripheral profile defining the string supporting surface and the two guide surfaces.

DETAILED DESCRIPTION OF THE PREFERRED EMBODIMENTS

Figure 1:
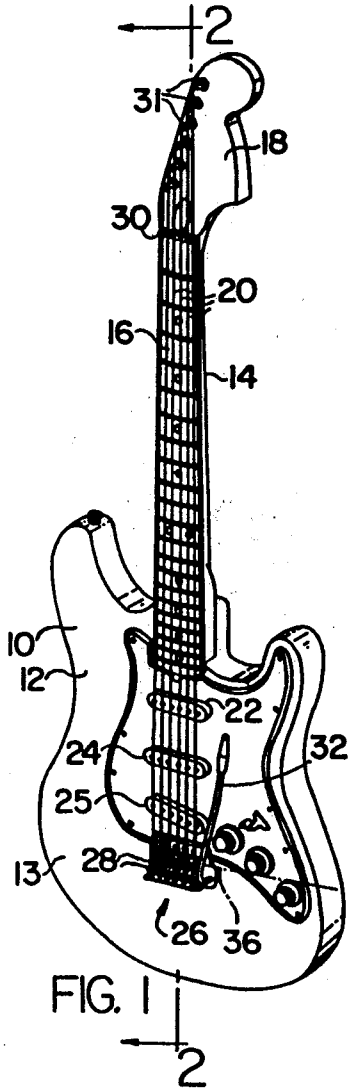
FIG. 1 is a perspective view of an electric guitar including a vibrato tailpiece embodying the present invention.

In FIG. 1 a guitar 10 is illustrated which embodies the invention. It is a solid body electrical guitar having a body 12, with a top surface 13, a neck 14 extending upwardly from the body, a fret board 16, a tuning head 18 at the outer end of the neck 14, strings 20, electrical pickups 22, 24 and 25 and a vibrato tailpiece 26. The vibrato tailpiece 26 serves both as an anchor for the lower ends of the strings 20 and as a bridge for such strings which individually extend from the tailpiece to a nut 30 carried by the neck 14 and located adjacent the outer end of the fret board 14, the strings further extending outwardly beyond the nut 14 to respectively associated tuning devices, such as well known manually operable machine heads 31,31, carried by the tuning head 18, with each machine head having the outer end of its associated string attached to it and being operable to apply a selected amount of tension to the string to bring it to a desired fundamental pitch. As explained in more detail hereinafter the vibrato tailpiece also serves as a means enabling the performer to controllably vary the tensions of the strings about their fundamental tension values to introduce variable pitch effects, such as vibrato, into the sound generated by the strings, and for this purpose it includes an actuating arm 32 operable by the performer.

Figure 2:
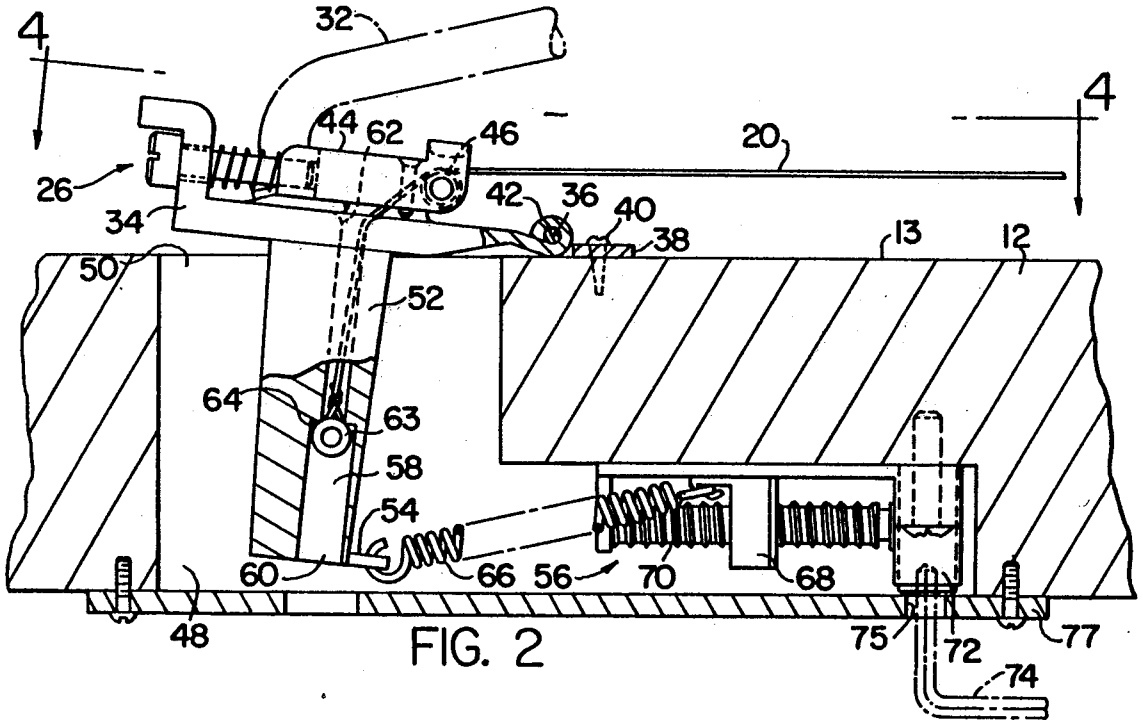
FIG. 2 is a fragmentary sectional view taken generally on the line 2—2 of FIG. 1 showing the vibrato tailpiece in its fundamental position.

FIG. 2 illustrates the vibrato tailpiece 26 in the fundamental position assumed by it when no forces are applied by the performer to the actuating arm 32. That is, in this position of the tailpiece the strings are at their fundamental tensions and pitches. As shown, the tailpiece includes a base 34 attached by suitable means to the top surface 13 of the guitar body 10 for rotation relative to the body 12 about a pivot axis 36 located below the strings 20 and extending perpendicularly to the strings and generally parallel to the top surface 13. Various different means may be employed for providing the base 34 with such pivotal support without departing from the invention, but in the illustrated case the support is provided by a hinge plate 38 fixed to the guitar body 12 by a number of screws 40 and hingedly connected to the base 34 by a hinge pin 42 defining the pivot axis 36. The actuating arm 32 is carried by the base 34 so that by applying forces to it the player can move the base 34 in one direction or the other about the pivot axis 36 from the fundamental position shown in FIG. 2.

Figure 4:
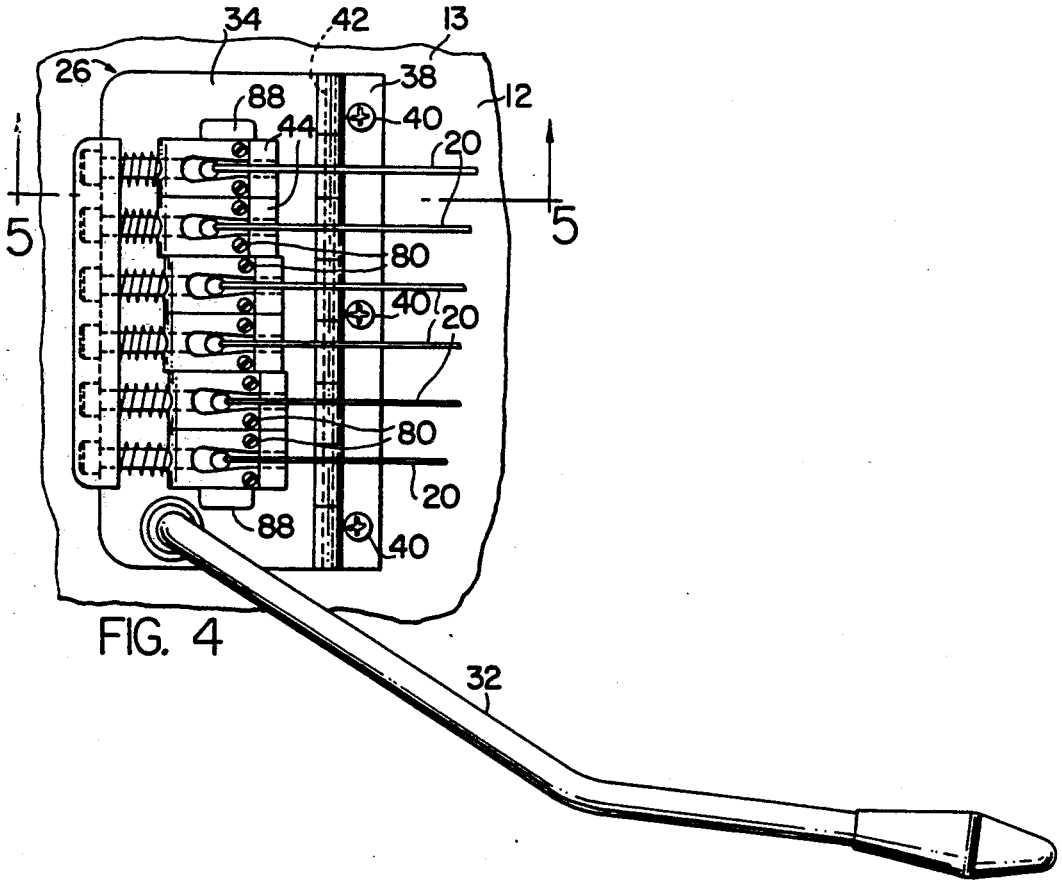
FIG. 4 is a plan view of the vibrato tailpiece of FIG. 2 and taken on the line 4—4 of FIG. 2.

The base 34 carries a number of saddles or bridge pieces 44 with there being one saddle 44 associated respectively with each of the strings 20 of the guitar as seen best in FIG. 4. Each saddle 44 provides a string supporting surface 46 for its associated string 20 which serves as the guitar's bridge for that string. That is, the active vibrating or playing length of each unstopped string extends from the string supporting surface 46 provided by its tailpiece saddle 44 to the nut 30 on the outer end of the neck.

The guitar body 12 includes a recess 48 having an opening 50 to the top surface 13 located directly below the tailpiece base 34. The base 34 includes a rear portion 52 which extends into the recess 48 and has a lower end 54 connected to an adjustable counter-tensioning mechanism indicated generally at 56. For each string 20 the base 34, as seen best in FIG. 2, includes a through opening 58 of stepped diameter extending from a bottom mouth 60 to an upper mouth 62. The lower or tailpiece end of each string is received in its associated opening 58 of the base 34 and is anchored to the base by its end bead 63 engaging the illustrated shoulder 64.

From FIG. 2 it will be obvious that the tension forces applied to the tailpiece base 34 by the strings 20 tend to rotate the base 34 in the clockwise direction about the pivot axis 36. The counter-tensioning mechanism 56 applies a counter-force to the base at the lower end 54 of the rear base portion 52 to urge the base 34 in the counterclockwise direction about the axis 36 and to normally hold the base 34 in the fundamental position of FIG. 2. The counter-tensioning mechanism may vary as to the details of its construction, but preferably and as illustrated it is one similar to that shown by U.S. Pat. No. 4,984,493 to which reference may be made for further details. For the present purposes it is sufficient to note that it includes one or more helical tension springs, such as the one shown at 66 in FIG. 2, connected between the lower end 54 of the tailpiece base and a slide 68 adjustably positionable relative to the guitar body in a direction extending parallel to the strings 20. The position of the slide 68 is determined by one or more screws, such as the one illustrated at 70, threadably engaged with the slide 68 and rotatable about their longitudinal axes by an associated worm gear device 72 which can be operated by a tool 74 inserted into the mechanism 72 through an opening 75 in a closure plate 77 closing the recess 48 at its bottom.

Figure 5:
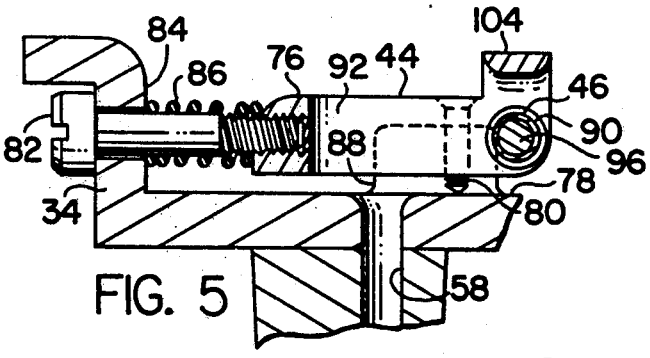
FIG. 5 is a fragmentary sectional view taken on the line 5—5 of FIG. 4.

Returning to the saddles 44 of the tailpiece 26, each saddle, as shown in FIGS. 2, 4 and 5, comprises a saddle body 76 supported on a generally flat upwardly facing surface 78 of the base 34 by two height adjusting screws 80 which are threaded into the saddle body and can be rotated to vary the height of the string supporting surface 46 from the surface 78. Each saddle 44 is further supported and positioned on the base 34 by an intonation adjusting screw 82 which passes through an upstanding wall 84 of the base 34 and has its free end threadably engaged with the saddle body 76. A helical compression spring 86 surrounding the shank of the screw 82 and located between the upstanding base wall 84 and the adjacent end of the saddle body 76 urges the saddle body in the direction toward the guitar nut 30. Therefore, by rotation of the screw 82 the string supporting surface 46 of the saddle may be moved toward and away from the nut 30 to vary the active or vibrating unstopped length of the string to thereby vary the intonation of the associated string when stopped against the various frets of the fret board. Upstanding bosses 88 formed on the base 34 slidably engaging the side faces of the outer ones of the set of saddles 44, and slidable coengaging side faces of neighboring ones of the saddles, restrain each saddle to sliding movement relative to the base 34 along a line parallel to the strings.

If the actuating arm 32 of the tailpiece is not operated or if it is operated only very lightly the friction forces existing between each string and its string supporting surface will normally retain the string in a fixed position relative to the string supporting surface even if the string supporting surface is one having a quite large length dimension in the direction perpendicular to the string. However, in previously known vibrato tailpiece mechanisms if the mechanism is operated to severely relax the string tension the strings may shift laterally of their string supporting surfaces and may not return to their original positions relative to the string supporting surfaces upon the tailpiece base being returned to its fundamental position, and this in turn produces tuning errors which the tailpiece construction of the present invention avoids.

Figure 3:
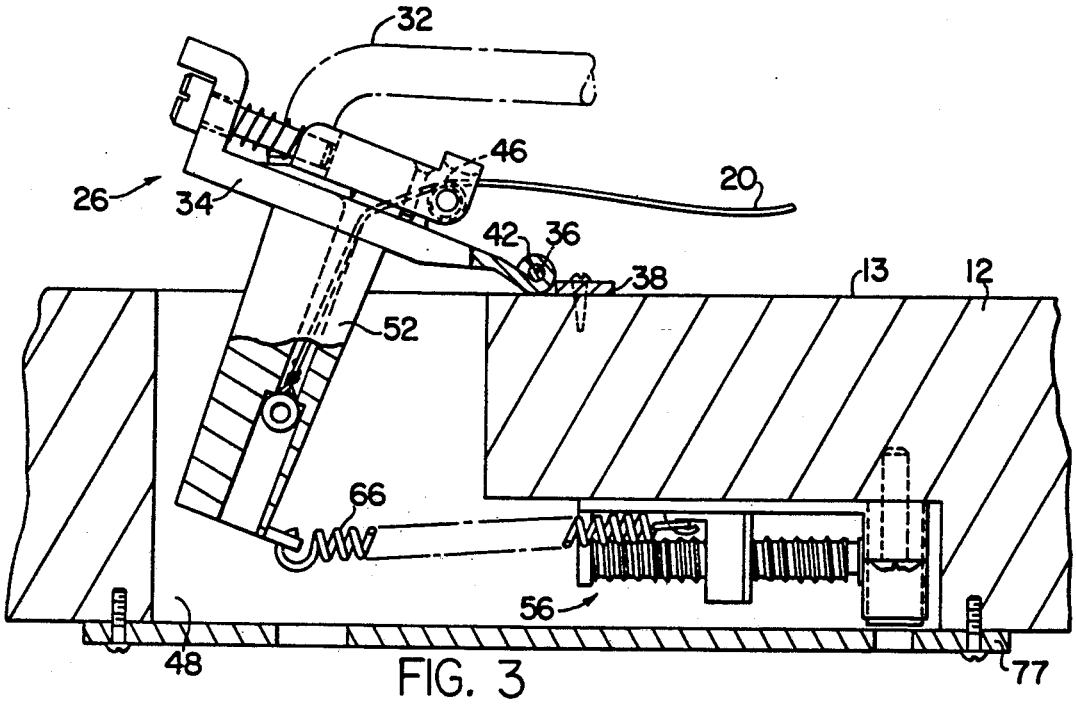
FIG. 3 is a view similar to FIG. 2 but showing the vibrato tailpiece in a position at which the guitar strings are in a completely loose condition.

Referring to FIG. 3, this figure illustrates the vibrato tailpiece 26 of FIG. 1 shifted by operation of the actuating arm 32 to a position advanced clockwise so far from the fundamental position of FIG. 2 that the strings 20 are completely free of tension and capable of moving loosely or floppily relative to the tailpiece 26 and other parts of the guitar. That is, the strings can and do move freely from the string supporting surfaces 46 of the tailpiece base 34. However, when the tailpiece 26 is returned to its fundamental position of FIG. 2 the construction of the tailpiece assures that each string is returned to its original given position relative to its string supporting surface. This is accomplished by making each string supporting surface with a length perpendicularly to the string substantially equal to the diameter of the string and by providing guide surfaces on either side of the string supporting surface which extend upwardly from the string supporting surface. Therefore, even if the string does move away from its string supporting surface the guide surfaces located on either side of it assure that when the string moves back into engagement v ith its string supporting surface it is guided back to its original position.

Figure 6:
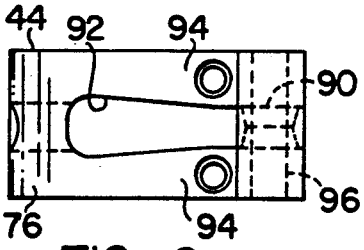
FIG. 6 is a plan view of one of the saddles of the tailpiece of FIG. 1.
Figure 7:
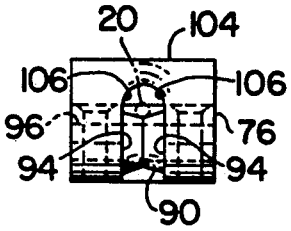
FIG. 7 is a right side elevational view of the saddle of FIG. 6.

The shape and particular way of providing the string supporting surface and the associated guide surfaces for each saddle may vary. In the embodiment of FIGS. 1 to 9 the string supporting surface and the two associated guide surfaces for each saddle 44 are provided by a roller 90 rotatably supported by the saddle body 76 for rotation about an axis extending perpendicularly to the strings. More particularly, each saddle body 76 as seen in FIGS. 4, 5 and 6 includes a recess 92 dividing the righthand end portion of the saddle body, as seen in these figures, into two side arms 94, and the roller 90 is located in the recess 92 between the two side arms 94 and supported by a shaft 96 passing through it and through the two side arms 94. The roller is rotatably supported on the shaft 96 for rotation relative to the saddle body and the shaft 96 is fixed to the side arms 94 as by a press fit.

Figure 8:
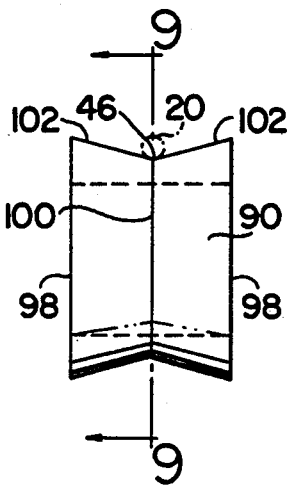
FIG. 8 is an enlarged scale front view of the roller of the saddle of FIG. 5.
Figure 9:
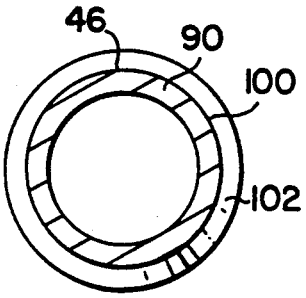
FIG. 9 is a sectional view taken on the line 9—9 of FIG. 8.

As seen best in FIG. 8 each roller 90 has two flat side faces 98 and midway between these side faces it includes an annular notch or fillet 100 which defines the string supporting surface 46 at the point along the circumference of the roller at which it is engaged by the associated string 20. On opposite sides of the string supporting surface 46 are two guide surfaces 102 which extend upwardly from the string supporting surface 46 and diverge from one another in doing so, the guide surfaces 102 being annular surfaces formed on the circumference of the roller adjacent the notch 100 and at the point where the string 20 engages the notch extending upwardly until terminating at the side faces 98. As seen best in FIGS. 5 and 7, the two side arms 94 of each saddle body 76 are connected to one another by a bridge portion 104 located above the roller 90. Above the roller 90 the side arms 94 include additional guide surfaces 106 adjacent the side faces 98 of the roller which further aid in guiding the associated string 20 back to its original given position on the string supporting surface 46. The string 20 therefore passes through a hole in the saddle 44 formed by the string supporting surface 46, the guide surfaces 102, the additional guide surfaces 106, and the bridge portion 104 so as to provide a definite limit to the permitted movement of the string away from its string supporting surface.

From the foregoing it will be understood that when the tailpiece base is returned from a relaxed position, such as that shown in FIG. 3, to the neutral position of FIG. 2 the guide surfaces 106 of the saddle body and the guide surfaces 102 of the roller 90 will guide the string back to its original position relative to the narrow supporting surface 46, and therefore the strings will have the same fundamental pitches as they had when the tailpiece base 34 was previously in its fundamental position. It will further be observed, that the tailpiece saddles are of relatively low profile and do not hinder access to those portions of the strings located near their string supporting surfaces so that the performer is not hindered in engaging the strings with his hand at these areas for muting purposes.

Figure 10:
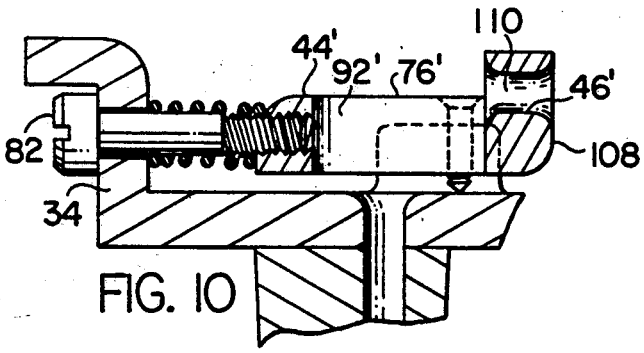
FIG. 10 is a view similar to FIG. 5 but showing a tailpiece comprising another embodiment of the invention.
Figure 11:
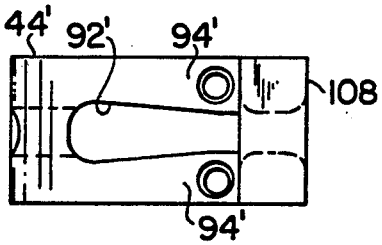
FIG. 11 is a plan view of the saddle of FIG. 10.
Figure 12:
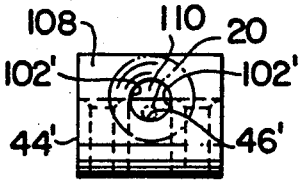
FIG. 12 is a right side elevational view of the saddle of FIG. 11.

FIGS. 10, 11 and 12 show an embodiment of the vibrato tailpiece which is identical to that of FIGS. 1 to 9 except that the string supporting surface of each saddle 44' is provided by the saddle body 76' itself rather than by a roller. Referring to these figures each saddle body 76' has a vertical recess 92' which divides the body into two side arms 94' which are connected to one another at their forward or right-hand ends as seen in FIGS. 10 and 11 by a forward wall 108. The string supporting surface 46' is defined in this forward wall 108 by a generally circular opening 110 passing therethrough along an axis extending parallel to the associated string. Therefore, as seen in FIG. 12 the bottomost portion of the inner surface of the opening 110 defines the string supporting surface 46' and those portions of the inner surface of the opening 110 located immediately to either side of the string supporting surface 46' define guide surfaces 102' which extend upwardly from the string supporting surface 46' and diverge from one another in doing so.

Figure 13:
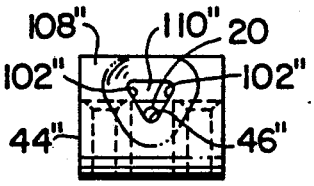
FIG. 13 is a view similar to FIG. 12 but showing a saddle used in a further embodiment of the invention.

FIG. 13 shows another embodiment of the invention which is identical to that of FIGS. 10 to 12 except that the hole 110" passing through the front wall 108" is of a somewhat triangular non-circular shape, as shown, to define a string supporting surface 46" located at the lowermost point of the opening and two guide surfaces 102" located on either side of the string supporting surface 46" and extending upwardly therefrom and diverging in doing so with the guide surfaces 102" having substantially straight shapes as seen in FIG. 13.

I claim:

1. In an electric guitar, the combination comprising:

a guitar body having a top surface, a neck attached to said guitar body and extending outwardly therefrom, said neck including a nut at its outer end and a tuning head located outwardly of said nut and carrying a plurality of tuning devices, a vibrato tailpiece attached to said guitar body and having a base and a plurality of saddles carried by said base, said saddles each having an upwardly facing string supporting surface located above and near said top surface of said body, a number of strings each attached to said tailpiece base and extending from said tailpiece base over the string supporting surface of a respective one of said saddles and over said nut to a respective one of said tuning devices which is manually operable to stretch the associated string between itself and said tailpiece base to apply a selected tension force to the string for tuning purposes, said vibrato tailpiece being attached to said guitar body by means permitting said base thereof to move relative to said guitar body about a pivot axis located below said strings and extending in a direction generally parallel to said top surface of said guitar body and perpendicularly to said strings so that the tension forces applied to said strings by said tuning devices tend to rotate said base about said pivot axis in one direction of rotation, a spring means connected between said tailpiece base and said guitar body for biasing said tailpiece base about said pivot axis in the direction of rotation opposite to the direction of rotation urged by the string tension forces, said tailpiece therefore having a fundamental positioned determined by the counteracting forces applied to it by said strings and by said spring means at which fundamental position said strings carry fundamental tension forces and have fundamental pitches, said vibrato tailpiece also including a manually operable actuating arm attached to said base allowing a player to manually apply additional forces to said tailpiece base to rotate said tailpiece base in one direction or the other about said pivot axis to vary the tension forces and pitches of said strings from their fundamental values, the range of movement of said tailpiece base by said actuating arm being such as to include positions of said tailpiece base at which said strings become free of tension forces and can move loosely relative to the string supporting surfaces of their respective saddles, the string supporting surface of each of said saddles having a dimension extending perpendicularly of said strings approximately equal to the diameter of the associated string and each of said saddles further having means defining guide surfaces extending upwardly on either side of its string supporting surface to restrain the associated string to movement to the same position on the string supporting surface of its saddle each time it moves from a tension-free condition to a tensioned condition as a result of operation of aid actuating arm, each of said saddles including a wall extending upwardly relative to said guitar body top surface, and said string supporting surface of each saddle and said guide surfaces of each saddle being provided by a hole through said upwardly extending wall of said saddle through which hole the associated string passes.

2. The combination defined in claim 1 further characterized by said hole being of generally circular shape.

3. The combination defined in claim 1 further characterized by said hole being of such shape as to include a lower notch defining said string supporting surface and two surfaces defining said guide surfaces which two surfaces extend upwardly from said notch on opposite sides thereof and diverge from one another in doing so.

4. The combination defined in claim 1 further characterized by each of said saddles including a saddle body, and a roller supported by the saddle body for rotation relative to the saddle body about an axis extending perpendicularly to the string and generally parallel to said top surface of the guitar body, said roller having a peripheral annular notch defining said string supporting surface and also having two annular surfaces defining said guide surfaces which two annular surfaces are located on opposite sides of said annular notch and at the point where the associated string engages said annular notch extend upwardly from said annular notch and diverge from one another in doing so, said peripheral annular notch and two annular surfaces of said roller defining part of said hole in said saddle.

5. The combination defined in claim 4 further characterized by said roller of each of said saddles having side faces on opposite sides thereof, said two annular guide surfaces of the roller diverging from one another until ending at said side faces, and said saddle body including additional guide surfaces defining part of said hole extending upwardly from said roller on opposite sides of said roller and adjacent to said side faces of said roller.

6. The combination defined in claim 5 further characterized by said additional side surfaces of each saddle body being connected to one another above the associated roller to define a further part of said hole through which the associated string passes.

7. A vibrato tailpiece for use as part of an electric guitar having a body and a plurality of strings, said tailpiece comprising:

a tailpiece base, means for attaching said tailpiece base to a guitar body for rotation about an axis extending generally perpendicularly to the guitar strings, means for anchoring one end of each string of the guitar to said tailpiece base, means carried by said tailpiece base providing a plurality of upwardly facing string supporting surfaces each associated with a respective one of the strings of the associated guitar and serving to support the associated string as a bridge, each of said string supporting surfaces having a dimension extending perpendicularly of the string to be supported thereby approximately equal to the diameter of the associated string, and means also carried by said tailpiece base providing for each of said string supporting surfaces a wall extending upwardly relative to said guitar strings, and for each of said strings a hole extending through the associated wall and through which hole the string extends, said hole providing said string supporting surface for the associated string and also restraining the associated string to movement to the same position on its string supporting surface each time the string moves into engagement with the string supporting surface from a condition of looseness relative to said string supporting surface.

8. A vibrato tailpiece for use as part of an electric guitar having a body and a plurality of strings, said tailpiece comprising:

a tailpiece base, means for attaching said tailpiece base to a guitar body for rotation about an axis extending generally perpendicularly to the guitar strings, means for anchoring one end of each string of the guitar to said tailpiece base, and a plurality of saddles carried by said tailpiece base each having an upwardly facing string supporting surface for supporting as a bridge an associated one of the guitar strings, said strings supporting surface of each of said saddles having a dimension extending perpendicularly of the string to be supported thereby approximately equal to the diameter of the associated string and each of said saddles including a wall extending upwardly relative to said guitar strings, said wall having a hole extending therethrough through which the associated string passes, said hole providing said string supporting surface for the associated string and also restraining said string to movement to the same position on the string supporting surface of the saddle each time it moves into engagement with said saddle from a condition of looseness relative to said saddle.

9. The combination defined in claim 8 further characterized by said hole being of generally circular shape.

10. The combination defined in claim 8 further characterized by said hole being of such shape as to include a lower notch defining said string supporting surface and two surfaces defining said guide surfaces which two surfaces extend upwardly from said notch on opposite sides thereof and diverge from one another in doing so.

11. The combination defined in claim 8 further characterized by each of said saddles including a saddle body, and a roller supported by the saddle body for rotation relative to the saddle body about an axis extending perpendicularly to the associated string, said roller having a peripheral annular notch defining said string supporting surface and also having two annular surfaces defining said guide surfaces which two annular surfaces are located on opposite sides of said annular notch and at the point where the associated string engages said annular notch extend upwardly from said annular notch and diverge from one another in doing so, said peripheral annular notch and two annular guide surfaces of said roller defining part of said hole in said saddle.

12. The combination defined in claim 11 further characterized by said roller of each of said saddles having side faces on opposite sides thereof, said two annular guide surfaces of the roller diverging from one another until ending at said side faces, and said saddle body including additional guide surfaces defining part of said hole extending upwardly from said roller on opposite sides of said roller and adjacent to said side faces of said roller.

13. The combination defined in claim 12 further characterized by said additional side surfaces of each saddle body being connected to one another above the associated roller to define a further part of said hole through which the associated string passes.

* * * * *